US007293753B1

(12) United States Patent
Kapp

(10) Patent No.: US 7,293,753 B1
(45) Date of Patent: Nov. 13, 2007

(54) FOUR-LEGGED ARTIST EASEL

(76) Inventor: Dennis R. Kapp, 4444 Lawton Ave., Detroit, MI (US) 48208

( * ) Notice: Subject to any disclaimer, the term of this patent is extended or adjusted under 35 U.S.C. 154(b) by 389 days.

(21) Appl. No.: 10/910,455

(22) Filed: Aug. 4, 2004

(51) Int. Cl.
*A47B 97/04* (2006.01)

(52) U.S. Cl. ..... 248/464; 248/170

(58) Field of Classification Search ..... 248/441.1, 248/464, 163.1, 170, 176, 440, 463, 188.5, 248/188.6
See application file for complete search history.

(56) References Cited

U.S. PATENT DOCUMENTS 2,582,070 A * 1/1952 Safer ..... 248/464
4,171,116 A 10/1979 Carver et al.
4,326,687 A 4/1982 Clyburn
4,596,484 A * 6/1986 Nakatani ..... 403/104
4,609,174 A 9/1986 Nakatani
5,125,613 A 6/1992 Albee, Jr. et al.
D346,287 S 4/1994 Rosen
6,206,183 B1 * 3/2001 Helsel ..... 206/1.7
6,601,805 B1 8/2003 Kapp

* cited by examiner

*Primary Examiner*—Ramon O Ramirez
(74) *Attorney, Agent, or Firm*—Charles W. Chandler

(57) ABSTRACT

An artist's easel having four legs that are pivoted at their upper ends on a pivot housing so that the lower ends can be spread to support an artist's board or collapsed to a position in which they are adjacent one another.

17 Claims, 4 Drawing Sheets

FOUR-LEGGED ARTIST EASEL

BACKGROUND AND SUMMARY OF THE INVENTION

This invention is related to an artist easel. Conventional artist's easels are supported by three legs in the form of a tripod. The easel's legs are moveable between a folded storage position in which the legs are parallel to one another, and a supported position in which the upper ends of the legs are connected at a common location. Some prior art easels may be found, for example, on U.S. Pat. No. 4,326,687 issued Apr. 27, 1982 to C. Wayne Clybum for "Plural Leg Stand"; U.S. Pat. No. 4,171,116 issued Oct. 16, 1979 to George E. Carver, et al. for "Adjustable and Collapsible Easel"; U.S. Pat. No. 5,125,613 issued to Jun. 30, 1992 to Percy F. Albee, Jr., et al. for "Easel"; and U.S. Pat. No. 4,609,174 issued Sep. 2, 1986 to Koma Nakatani for "Foldable Easel" and U.S. Pat. No. 6,601,805 issued Aug. 5, 2003 to Dennis Kapp. These easels are all characterized by having the upper ends of the legs pivotally connected at a location closely adjacent one to the other.

Some four-legged easels are known in the art, however, they usually comprise two pairs of legs having their upper ends joined on opposite sides of a display board or the like. An example may be found in Design Pat. 346,287 issued Apr. 26, 1994 to Lawrence Rosen for "Convertible Easel".

The broad purpose of the present invention is to provide a four-legged easel in which the upper ends of four legs converge toward a common pivot structure. A slideable spine is frictionally mounted on the pivot structure so that it can be raised or lowered to a height accommodating the artist's needs. The two front legs are mounted so that they swing in a common plane between their supporting and their storage positions. The two rear legs pivot in planes that form an acute angle with the plane of motion of the two front legs.

The pivot structure has abutments that limit the spread of the four legs. This arrangement obviates the need for braces connected between the legs to prevent their collapsing.

Still further objects and advantages of the invention will become readily apparent to those skilled in the art to which the invention pertains upon reference to the following detailed description.

DESCRIPTION OF THE DRAWINGS

The drawings illustrate a preferred embodiment of the invention and include.

DESCRIPTION OF THE PREFERRED EMBODIMENT

Figure 1:
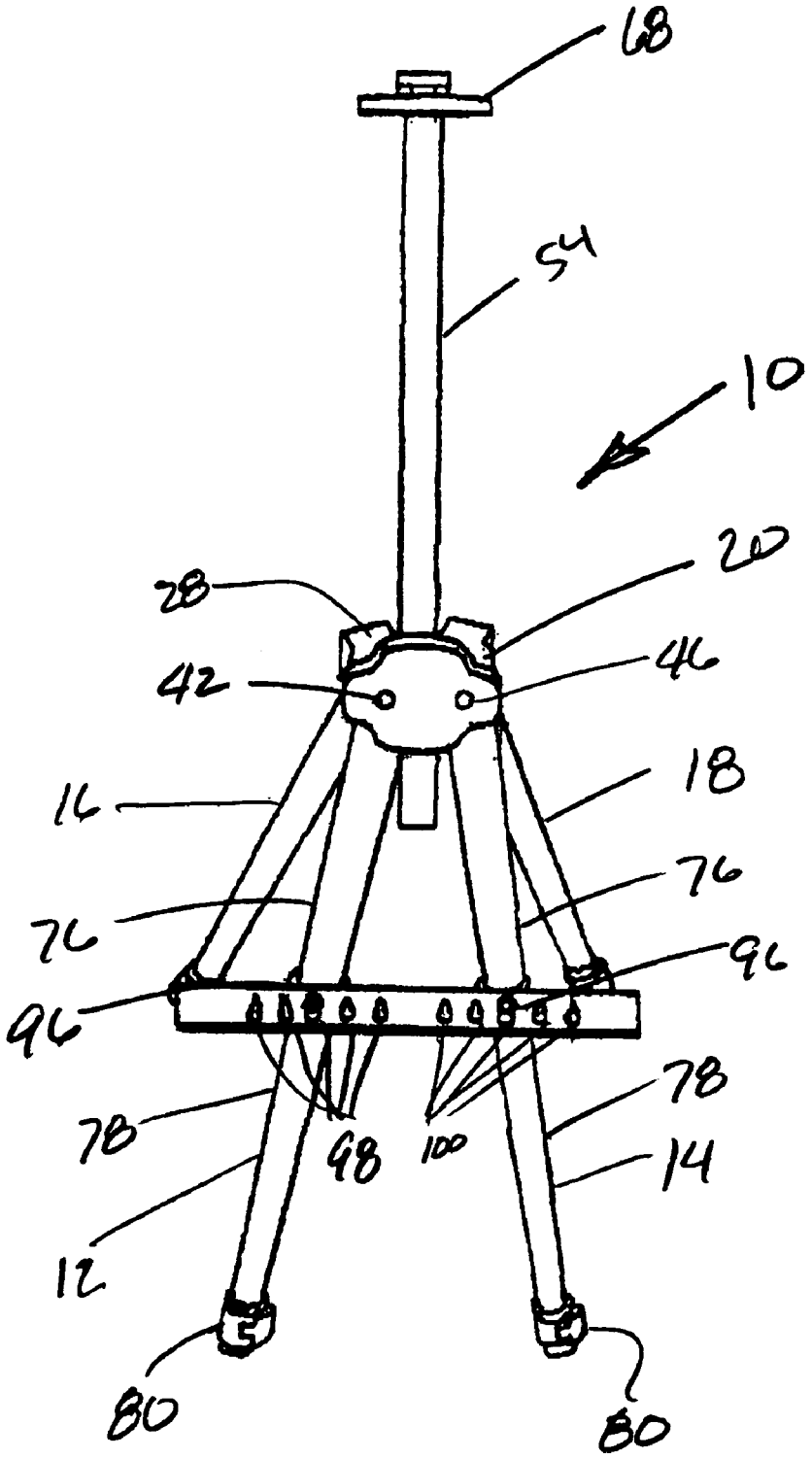
FIG. 1 is a perspective view of an easel illustrating the preferred embodiment of the invention.

Referring to the drawings, a preferred four-legged artist easel 10 includes front legs 12, and 14, and rear legs 16 and 18. Each leg has an upper end and a lower end and comprises a pair of telescopic leg sections to permit the selective extension of each leg in a manner to be described. The upper ends of the four legs are pivotally connected to a pivot retaining structure 20.

Figure 2:
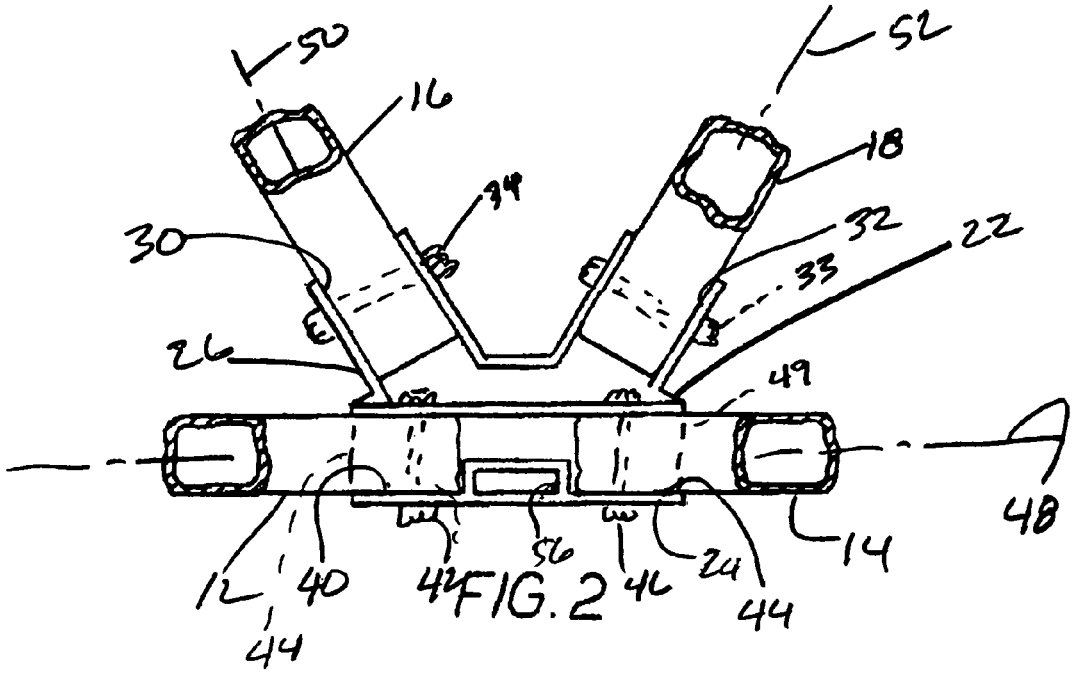
FIG. 2 is a sectional view of the pivot structure showing the upper ends of four legs.
Figure 3:
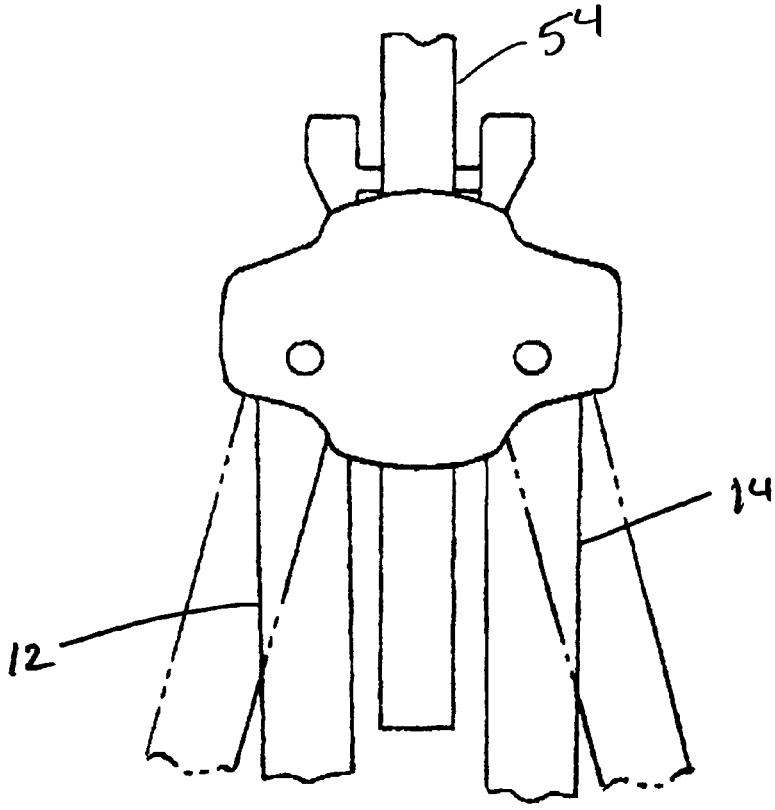
FIG. 3 is a fragmentary front view of the upper ends of the front legs showing the manner in which the two front legs pivot.

Referring to FIGS. 1 and 2, retaining structure 20 includes a housing 22 having a front wall 24, and a side wall 26 which extend downwardly from a top wall 28, as best shown in FIG. 2.

Figure 8:
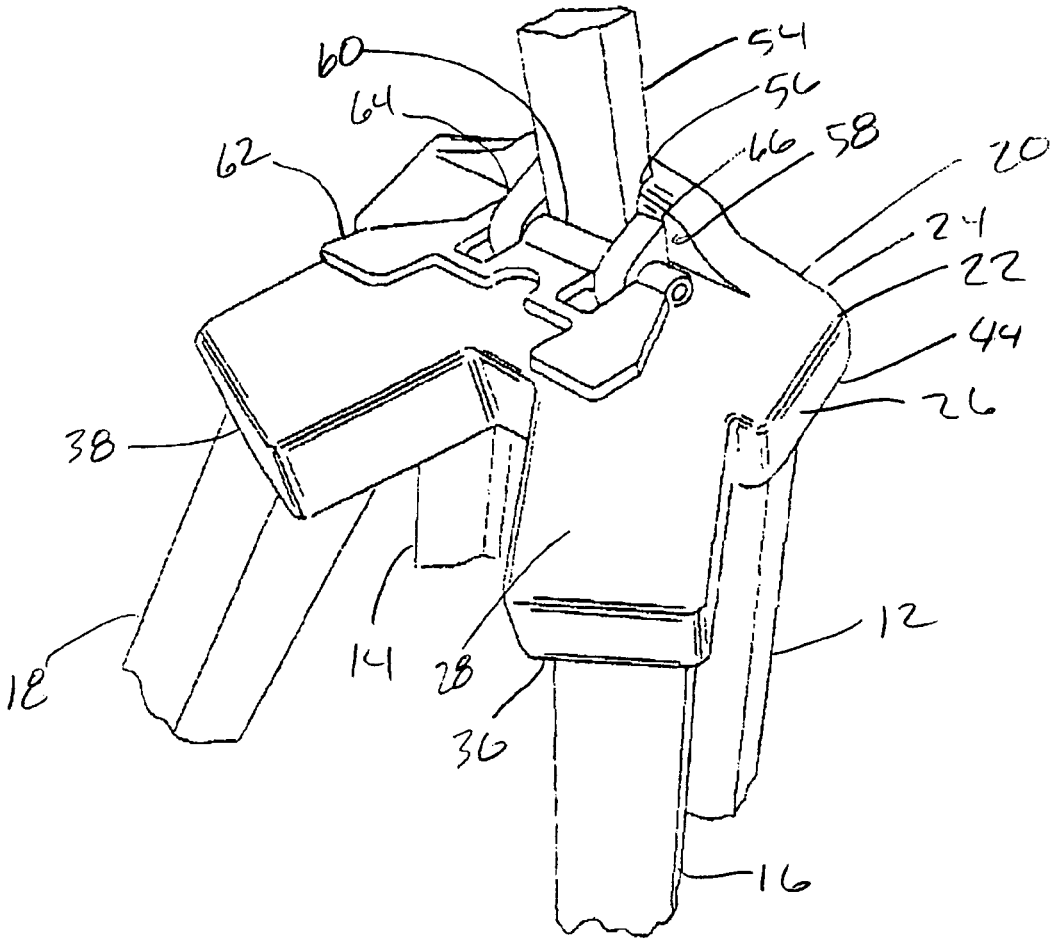
FIG. 8 is another view of the pivot structure to show the manner in which a lock on the pivot housing frictionally engages the spine member.

Side wall 26 has an opening 30 and a second opening 32. Opening 30 slidably receives the upper end of leg 16. A fastener 34 pivotally connects the upper end of leg 16 to the sides of opening 30. Leg 16 can then pivot from a collapsed position to an open supporting position, as illustrated in FIG. 1. The open supporting position is limited by an abutment 36 formed on the lower edge of the side wall, as illustrated in FIG. 8. The location of the abutment is such that leg 16 can open to a supporting position in which it forms an acute angle with its collapsed position. The abutment prevents the leg from opening any further.

Still referring to FIGS. 2 and 8, opening 32 of the side wall slidably receives the upper end of leg 18. A fastener 33 pivotally connects leg 18 to the retainer housing, and also provides means permitting leg 18 to pivot from an inner collapsed position, and an outer supporting position illustrated in FIG. 1. The lower edge of the side wall forms an abutment 38 which defines the outer supporting position of the leg and prevents it from opening further.

The front retainer wall and the side wall form an opening 40 for slidably receiving the upper end of leg 12. A fastener 42 forms a pivot means for the leg to swing with respect to housing 22 and also connects the upper end of the leg to housing 22. Referring to FIG. 8, the retainer housing also defines an abutment 44 which limits the outer supporting location of the lower end of leg 12.

The front retainer wall and the side wall also define an opening 44 for slidably receiving the upper end of leg 14. A fastener 46 provides means for pivotally connecting the upper end of leg 14 to housing 22 and also for connecting leg 14 to housing 22.

Referring to FIG. 2, front legs 12 and 14 are thus pivotable toward and away from one another in a plane 48. Leg 16 is pivotable in a plane 50 that forms an acute angle with plane 48. Similarly, leg 18 is swingable in a plane 52 that forms an acute angle with respect to plane 48. Leg 14 is swingable to an outer position in which an abutment 49, formed by the retainer side wall defines the outer supporting position of leg 14. The arrangement of the abutments and the legs provide a means for defining the open supporting position of the four legs and obviates the necessity for the braces that typically connect such easel legs together.

Referring to FIGS. 1 and 8, an elongated spine 54 is slidably receivable in an opening in housing 22. A cam locking device 58 is mounted on the top wall of housing 22 and has a cam component 60 that is engageable with the spine. A handle 62 connected to the cam and supported in a pair of journals 64 and 66 provides means for unlocking the spine so that it can be raised or lowered to a selected position, and then locked to housing 22 by raising handle 62 upwardly in the manner generally known to those skilled in the art.

Figure 9:
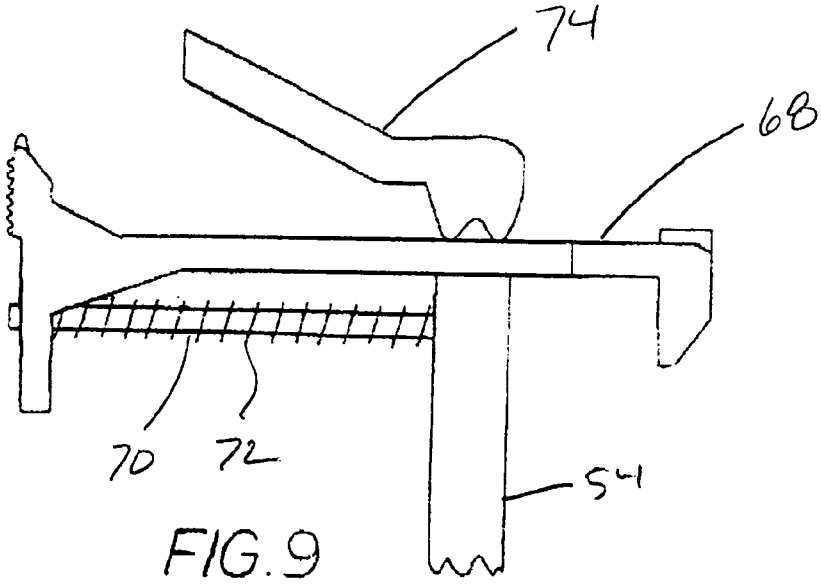
FIG. 9 is a fragmentary view of the upper support board retaining structure.

An upper board retainer 68, as best shown in FIG. 9 is mounted on spine 54 for retaining the upper edge of an artist's board, not shown. Retainer 68 is mounted on a pin 70 so that it can be moved either outwardly to receive the artist's board or inwardly in which it engages the upper edge of the board. A spring 72 biases retainer 68 to the left as viewed in FIG. 9. A cam lock 74 locks retainer 68 to spine 54.

Figure 7:
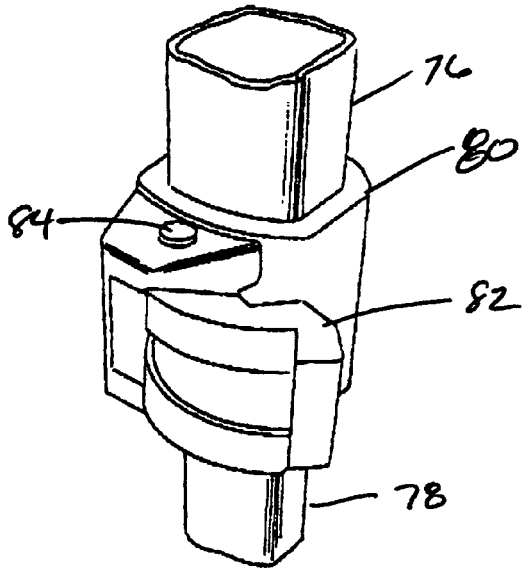
FIG. 7 is view of a cam lock for connecting a pair of telescopically mounted leg sections.

Referring to FIGS. 1 and 7, each leg comprises an upper leg section 76 and a lower leg section 78. Upper leg section 76 and lower leg section 78 are telescopically engaged such that the lower leg section can be extended to any suitable length to accommodate the position of the easel board.

Another cam-operated locking device 80 is mounted on upper leg section 76 to engage the lower leg section 78. A handle 82 is mounted on a cam pivot pin 84 and swings in one direction to release the two legs for a telescopic motion, or swings in the opposite direction as illustrated in FIG. 7 to lock the two leg sections together. Such cam operated locking devices are known in the art.

Figure 4:
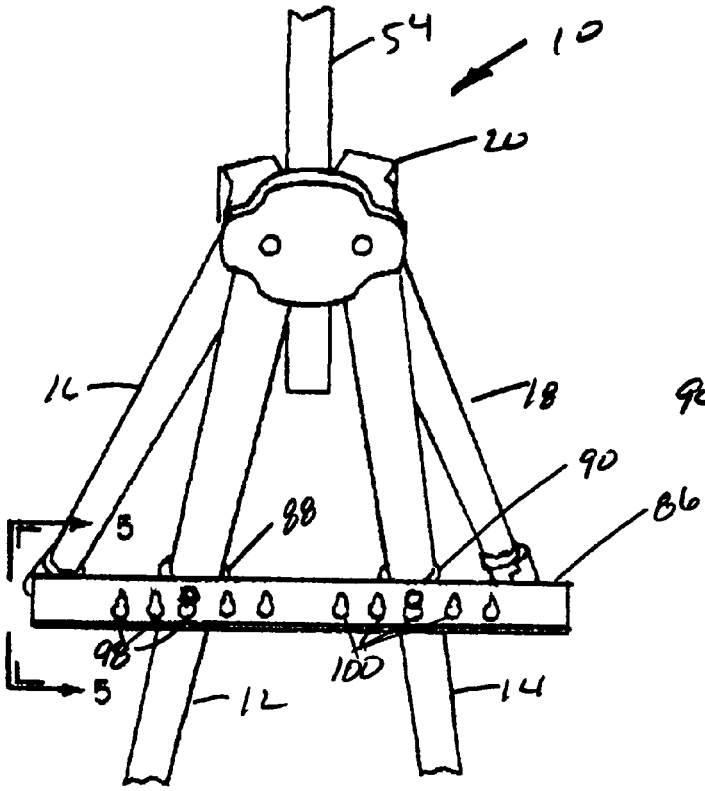
FIG. 4 is a view of the lower artist's board supporting bar.
Figure 6:
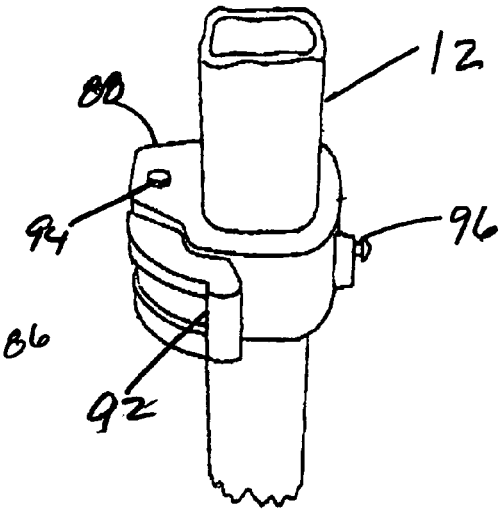
FIG. 6 illustrates a cam lock for adjusting the height of the board support bar.
Figure 5:
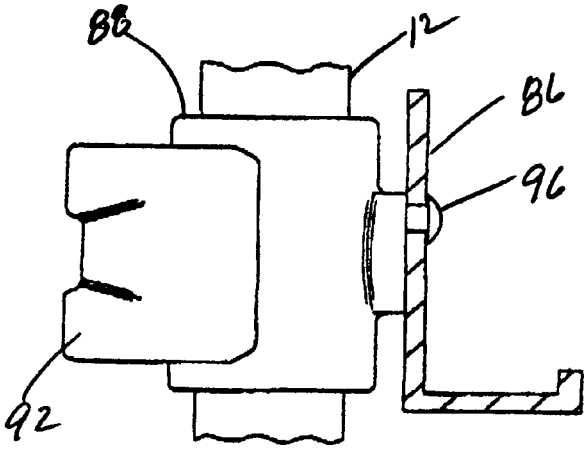
FIG. 5 is an enlarged view as seen along lines 5-5 of FIG. 4.

Referring to FIGS. 4-6, a lower L-shaped board supporting bar 86 is positioned to receive the lower edge of an artist's board. Supporting bar 86 is supported on front legs 12 and 14 by a pair of cam-operated locking devices 88 and 90. The two locking devices are identical so that a description of device 88 applies to device 90. Locking device 88 is slidably mounted on leg 12 and carries a cam handle 92 that can be pivoted about a pin 94 for either locking or releasing the locking device on leg 12.

Typically, locking device 88 is positioned at a suitable height on leg 12 and then locked in position. In its locked position, a cam carried by pin 94 engages the leg to lock the locking device in position. A pin 96 with a head is mounted on the front end of the two locking devices.

Supporting bar 86 has a series of spaced keyhole-shaped openings 98 adjacent leg 12, and another series of horizontally spaced keyhole-shaped openings 100 adjacent leg 14. The height of the supporting bar is adjusted and then pins 96 on the two front legs are inserted through the key hole openings to provide a means for supporting bar 86 in its horizontal position as well as the weight of the artist's board.

Thus it is to be understood that I have described a novel four-legged artists easel in which the upper ends of the legs are pivotally connected to a pivot retaining structure which in turn frictionally engages a spine. The height of the spine which supports the artist's board can be adjusted to accommodate the user's desires.

Having described my invention, I claim:

1. A four-legged easel, comprising:

a retaining structure having a first side and a second side;

a first leg and a second leg each having upper ends pivotally connected to the retaining structure about spaced parallel axes, and swingable about their respective axes in a common plane between an outward ground-engaging supporting position, and an inward storage position in which the first leg is parallel to the second leg, a third leg having an upper end pivotally connected to the retaining structure, the third leg being swingable between a storage position and a supporting position in a second plane forming an acute angle with said first plane;

a fourth leg having an upper end pivotally connected to the retaining structure so as to be swingable between a storage position and a supporting position in a third plane forming an angle with said first plane;

a spine member and means for frictionally connecting the spine member to the retaining structure; and a board support on the spine member;

wherein said legs are unfolded to engage an abutment on the retaining structure when said legs are in said supporting position and said abutments prevent further unfolding of each leg from said folded position.

2. A four-legged easel as defined in claim 1, including an upper board support mounted on the spine member above the retaining structure and a lower board support mounted on the spine member below the retaining structure.

3. A four-legged easel as defined in claim 2, in which the lower board support includes a horizontal bar removably connected to the first leg and the second leg.

4. A four-legged easel as defined in claim 2, in which the spine member is supported on said retaining structure between the first leg and the second leg.

5. A four-legged easel as defined in claim 1, in which each of said legs comprises at least two telescopically slideable leg sections, and a locking member for locking said leg sections in an adjusted extended position.

6. A four-legged easel as defined in claim 1, in which the third leg is swingable in said second plane away from said first leg, and the fourth leg is swingable in said third plane away from said second leg.

7. An improved collapsible four-legged easel, comprising:

four support legs, each having upper ends and lower ground-engaging ends;

a spine member;

a board support;

a retaining structure for frictionally connecting the upper ends of the legs to a selected position on the spine member, and for pivotally connecting the upper ends of the four support legs to the retaining structure for movement between a folded position in which the four legs are adjacent and parallel, one to the other, and a supporting position in which the legs are unfolded to engage an abutment on the retaining structure, each leg being swingable to said supporting position, in which the abutments prevent further unfolding of each leg from said folded position.

8. A four-legged easel as defined in claim 7, including an upper board support mounted on the spine member above the retaining structure and a lower board support mounted on the spine member below the retaining structure.

9. A four-legged easel as defined in claim 8, in which the lower board support includes a horizontal bar removably connected to the first leg and the second leg.

10. A four-legged easel as defined in claim 8, in which the spine member is supported on said retaining structure between the two front-most legs.

11. A four-legged easel as defined in claim 7, in which each of said legs comprises at least two telescopically slideable leg sections, and a locking member for locking said leg sections in an adjusted extended position.

12. An easel, comprising:

a retaining structure having a first side and a second side;

a first leg and a second leg each having upper ends pivotally connected to the retaining structure about spaced parallel axes, and swingable about their respective axes in a common plane between an outward ground-engaging position, and an inward folded position in which the first leg is parallel to the second leg, a third leg having an upper end pivotally connected to the retaining structure;

the third leg being swingable between a folded position and a ground-engaging position in a second plane forming an acute angle with said first plane;

a fourth leg having an upper end pivotally connected to the retaining structure so as to be swingable between a folded position and a ground-engaging position in a third plane forming an angle with said first plane;

a spine member and means for frictionally connecting the spine member to the retaining structure; and a board support horizontally mounted on the spine member;

wherein said retaining structure includes abutment means which prevent further unfolding of each leg beyond said ground-engaging position.

13. An easel as defined in claim 12, including an upper board support mounted on the spine member above the retaining structure and a lower board support mounted on the spine member below the retaining structure.

14. An easel as defined in claim 13, in which the lower board support includes a horizontal bar removably connected to the first leg and the second leg.

15. An easel as defined in claim 13, in which the spine member is supported on said retaining structure between the first leg and the second leg.

16. An easel as defined in claim 12, in which each of said legs comprises at least two telescopically slideable leg sections, and a locking member for locking said leg sections in an adjusted extended position.

17. An easel as defined in claim 12, in which the third leg is swingable in said second plane away from said first leg, and the fourth leg is swingable in said third plane away from said second leg.

* * * * *